US010894689B2

(12) United States Patent
Tai

(10) Patent No.: US 10,894,689 B2
(45) Date of Patent: Jan. 19, 2021

(54) SHEET TYPE DETERMINING DEVICE AND IMAGE FORMING DEVICE

(71) Applicant: Konica Minolta, Inc., Tokyo (JP)

(72) Inventor: Haruka Tai, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 59 days.

(21) Appl. No.: 16/214,729

(22) Filed: Dec. 10, 2018

(65) Prior Publication Data

US 2019/0187605 A1 Jun. 20, 2019

(30) Foreign Application Priority Data

Dec. 14, 2017 (JP) ..... 2017-239846

(51) Int. Cl.

| | |
|---|---|
| ***B65H 43/08*** | (2006.01) |
| ***B65H 5/38*** | (2006.01) |
| ***G03G 15/00*** | (2006.01) |
| *G03G 15/20* | (2006.01) |

(52) U.S. Cl.

CPC ..... *B65H 43/08* (2013.01); *B65H 5/38* (2013.01); *G03G 15/5029* (2013.01); *B65H 2515/60* (2013.01); *G03G 15/2064* (2013.01); *G03G 2215/00616* (2013.01); *G03G 2215/00721* (2013.01); *G03G 2215/00751* (2013.01)

(58) Field of Classification Search

CPC ..... B65H 2515/60; B65H 43/08; B65H 2553/30; B65H 2553/40; B65H 2553/41; B65H 2553/412; B65H 2553/414; B65H 2553/416; B65H 2553/44; B65H 2553/442; G03G 2215/00616; G03G 2215/0062; G03G 2215/00637

See application file for complete search history.

(56) References Cited

U.S. PATENT DOCUMENTS

| | | | | |
|---|---|---|---|---|
| 5,859,440 A * | 1/1999 | Acquaviva | ..... | B65H 7/14 250/223 R |
| 6,540,222 B2 * | 4/2003 | Araki | ..... | B65H 3/06 271/10.11 |
| 7,343,689 B2 * | 3/2008 | Kondo | ..... | G01B 11/0691 33/501.02 |

(Continued)

FOREIGN PATENT DOCUMENTS

| | | |
|---|---|---|
| JP | 2010156771 A | 7/2010 |
| JP | 2016117560 A | 6/2016 |

*Primary Examiner* — Jeremy R Severson

(74) *Attorney, Agent, or Firm* — Cantor Colburn LLP

(57) ABSTRACT

A sheet type determining device including a guide that guides a sheet along a sheet conveyance path to a destination. The sheet conveyance path is between a first guide surface and a second guide surface facing each other across an interval. The sheet type determining device further includes a determiner that determines a sheet type when the sheet is in the sheet conveyance path, without having contact with the sheet in conveyance, and one or more regulators that regulate a displacement range of the sheet at a determining position, the displacement range being in a direction of the interval of the first and the second guide surfaces. Each of the regulators is a member that protrudes in an arc shape from the first or the second guide surface toward the guide surface opposite, and is spaced from the guide surface or another one of the regulators opposite.

11 Claims, 13 Drawing Sheets

< arc shaped rib portions >

(56) References Cited

U.S. PATENT DOCUMENTS

| | | | | |
|---|---|---|---|---|
| 7,654,522 | B2 * | 2/2010 | Tonami | B65H 7/125<br>271/262 |
| 8,585,053 | B2 * | 11/2013 | Doan | B65H 43/00<br>271/264 |
| 9,802,776 | B2 * | 10/2017 | Fukusaka | B65H 7/02 |
| 2007/0090592 | A1 * | 4/2007 | Nakada | G07D 7/185<br>271/265.01 |

* cited by examiner first sensor second sensor

< when distance to record sheet S is short >

< when distance to record sheet S is long >

< cylindrical protrusion >

< arc shaped rib portions >

(pattern 1)

arrangement of rollers at upstream side and downstream side in sheet conveyance direction (pattern 2)

arrangement of rollers at upstream side and downstream side in sheet conveyance direction (pattern 3)

arrangement of rollers at upstream side
and downstream side in sheet conveyance direction (pattern 4)

arrangement of rollers at upstream side
and downstream side in sheet conveyance direction

SHEET TYPE DETERMINING DEVICE AND IMAGE FORMING DEVICE

CROSS REFERENCE TO RELATED APPLICATION

The present application claims priority under 35 U.S.C. § 119 to Japanese Patent Application No. 2017-239846 filed Dec. 14, 2017, the contents of which are hereby incorporated herein by reference in their entirety.

BACKGROUND

Technical Field

The present disclosure relates to a sheet type determining device and an image forming device, particularly to a technology which increases an accuracy in determining the sheet type while suppressing occurrence of failures when thin paper is used for recording sheets.

Description of the Related Art

Recently, for electrographic image forming devices, image forming is being performed using various types of recording sheets. For example, when thick paper is used, as heat capacities of the recording sheets are large and heat-fixings of toner images take time, system speeds slow down compared to when regular paper is used. As the image forming needs to be controlled according to the sheet types of the recording sheets, the sheet types of the recording sheets must be determined before starting the image forming.

The sheet types of the recording sheets can be designated by a user, for example, by selecting a paper feed cassette housing the recording sheets. However, if the selected paper feed cassette houses a sheet type different from the recording sheet the user intends to choose, the image forming for the designated sheet type cannot be performed. Moreover, checking the sheet types of the recording sheets housed in the paper feed cassette for designating sheet types is not convenient for the user.

In view of this problem, a technology has been proposed in which ultrasonic waves or laser light are radiated on the recording sheets, so that the sheet types are automatically determined by detecting transmittance and reflectance of the recording sheets. Thus, the image forming according to the sheet types is performed without troubling the user.

However, switching controls for the image forming according to the sheet types of the recording sheets requires some time, and thus, preferably, the sheet types are determined immediately after the recording sheets are fed out from the paper feed cassette so as to maintain productivity of the image forming processing without decreasing the number of the recording sheets printed per unit time.

Recently, multi-function peripherals (MFPs) which include multiple paper feed cassettes and can also feed the recording sheets from a manual feed tray have become popular. In these MFPs, the recording sheets enter a sheet conveyance path from various directions, and thus positional relationships between the recording sheet and an ultrasonic sensor or a photosensor are not always constant in the sheet conveyance path. This may lead to erroneous determinations of the sheet types.

In view of this problem, a structure is proposed in which a pressing member such as an arm is in pressure contact with a sheet guide which forms the sheet conveyance path, and sheets are fed between the pressing member and the sheet guide in pressure contact, so that the recording sheet moving through the sheet conveyance path is pressed against the sheet guide (see JP2016-117560). By taking such a measure to regulate a conveyance position of the recording sheet at a sensor position on the sheet conveyance path, the positional relationship between the sensor and the recording sheet is stabilized, and thus occurrences of the erroneous determinations of the sheet types are reduced.

However, with the above described configuration, when thin paper having little firmness is used for the recording sheet, if a pressure contact force applied to the pressing member and the sheet guide is excessive, the recording sheet cannot enter between the pressing member and the sheet guide, and thus a sheet jam may occur. Naturally, the sheet jam prevents the recording sheet from moving to the sensor position, and thus the sheet type of the recording sheet cannot be identified.

Alternatively, when the pressure contact force applied to the pressing member and the sheet guide is insufficient, and when thick paper is used for the recording sheet, the conveyance position of the recording sheet cannot be fully regulated because of rigidity of thick paper, and thus the occurrences of the erroneous determinations of the sheet types cannot be reduced.

SUMMARY

The present disclosure has been made in consideration of the above-described problems, and an object of the present disclosure is to provide a sheet type determining device and an image forming device which increase a determination accuracy of the sheet types while suppressing occurrence of failures when thin paper is used for recording sheets.

In order to achieve the above mentioned object, a sheet type determining device reflecting one aspect of the present disclosure is a sheet type determining device including a guide that guides a sheet along a sheet conveyance path to a destination, the sheet conveyance path being between a first guide surface and a second guide surface disposed facing each other across an interval; a determiner that determines a sheet type when the sheet is in the sheet conveyance path, without having contact with the sheet in conveyance; and one or more regulators, each of the regulators regulating a displacement range of the sheet in a direction of the interval between the first and the second guide surfaces, at a detection position (determining position) in the sheet conveyance path where the determiner determines the sheet type, wherein each of the regulators is a member that protrudes in an arc shape from the first or the second guide surface toward the guide surface opposite, and each of the regulators is spaced from the guide surface or another one of the regulators opposite in a direction perpendicular to a surface of the sheet.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the invention. In the drawings:

FIG. 9B-1, FIG. 9B-2, FIG. 9B-3, and FIG. 9B-4 are diagrams of arrangement patterns of rollers 900 disposed at the upstream side and a downstream side in the sheet conveyance direction according to at least one embodiment.

DETAILED DESCRIPTION OF THE EMBODIMENTS

Hereinafter, one or more embodiments of the present disclosure will be described with reference to the drawings. However, the scope of the invention is not limited to the disclosed embodiments.

1. Configuration of Image Forming Device

First, a configuration of an image forming device according to the present embodiment will be described.

Figure 1:
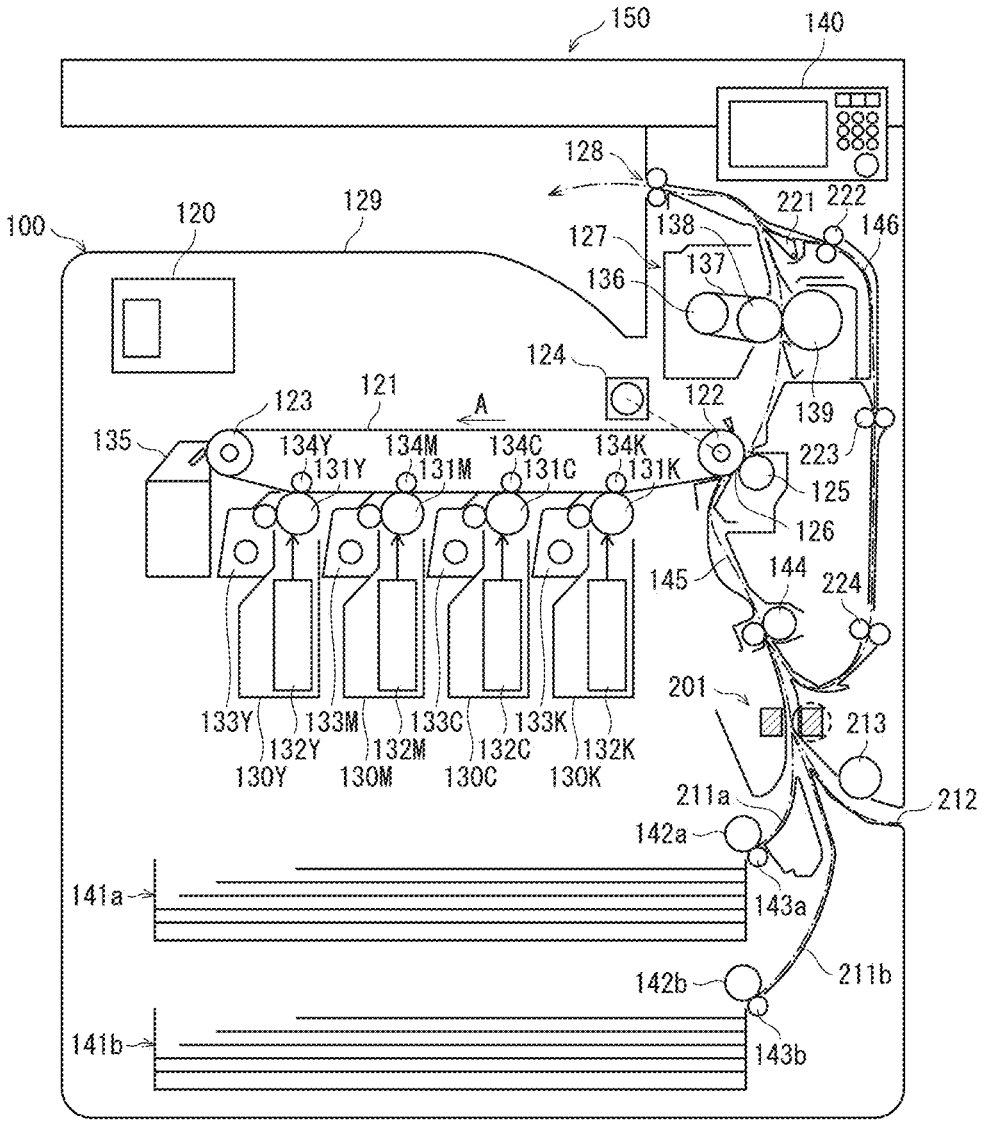
FIG. 1 is a diagram of a main configuration of an image forming device according to at least one embodiment of the present disclosure.

As in FIG. 1, an image forming device 1 according to at least one embodiment is a copying device that uses a tandem electrophotographic method to form polychromatic images, and includes an image forming unit 100 and an image reading unit 150. The image reading unit 150 optically reads an image from documents which are placed on a glass platen (not illustrated) or conveyed by an automatic document feeder (ADF) (not illustrated), and separates colors of the image into red, green, and blue (RGB) three primary colors to generate polychromatic image data.

The image forming unit 100 includes a controller 120. The controller 120 performs image processing on the polychromatic image data generated by the image reading unit 150, and makes the image forming unit 100 perform polychromatic image forming processing using the polychromatic image data. The controller 120 may accept a print job from an external device such as a personal computer (PC) to perform the image forming processing.

The image forming processing is performed by forming yellow (Y), magenta (M), cyan (C) and black (K) toner images respectively by four imaging units 130Y, 130M, 130C, and 130K. The imaging units 130Y, 130M, 130C, and 130K respectively include photosensitive drums 131Y, 131M, 131C and 131K, laser scanning optical units 132Y, 132M, 132C and 132K, and developing units 133Y, 133M, 133C, and 133K. Each of the imaging units 130Y, 130M, 130C, and 130K further include a charging unit (not illustrated) and a cleaning unit (not illustrated).

The charging unit uniformly charges outer circumferential surfaces of the photosensitive drums 131Y, 131M, 131C, and 131K, and the laser scanning optical units 132Y, 132M, 132C, and 132K apply laser lights modulated according to digital image data for each color component to the outer circumferential surfaces of the photosensitive drums 131Y, 131M, 131C, and 131K. As a result, electrostatic latent images are formed.

The developing units 133Y, 133M, 133C, and 133K respectively supply Y, M, C, and K toners and develop the electrostatic latent images to form Y, M, C, and K toner images. The imaging units 130Y, 130M, 130C, and 130K are disposed directly under and along an intermediate transfer belt 121.

Primary transfer rollers 134Y, 134M, 134C, and 134K are respectively disposed in positions facing the photosensitive drums 131Y, 131M, 131C, and 131K, having the intermediate transfer belt 121 disposed therebetween. A primary transfer voltage is applied to the primary transfer rollers 134Y, 134M, 134C, and 134K, and causes the toner images carried on the photosensitive drums 131Y, 131M, 131C, and 131K to be electrostatically transferred (primary transfer) onto the belt 121 such that the toner images overlap each other. As a result, a polychromatic toner image is formed.

The intermediate transfer belt 121 is an endless belt, which is tensioned by a driving roller 122, a driven roller 123, and the primary transfer rollers 134Y, 134M, 134C, and 134K. The intermediate transfer belt 121 is driven by a motor 124 driving the driving roller 122 to rotate in a direction indicated by an arrow A. A secondary transfer roller 125 is in pressure contact with the driving roller 122 via the intermediate transfer belt 121 to form a secondary transfer nip 126 therebetween.

Paper feed cassettes 141*a* and 141*b* which store the recording sheets S in stacks are installed in a lower part of the image forming unit 100. Sheet feed rollers 142*a* and 142*b* respectively feed out the recording sheets S from the paper feed cassettes 141*a* and 141*b*. Handling rollers 143*a* and 143*b* prevent double feeding when the recording sheets S are fed out.

The recording sheets S fed out from the paper feed cassettes 141*a* and 141*b* are conveyed to sheet conveyance path 145 respectively via sheet conveyance paths 211*a* and 211*b*. The recording sheets S supplied from a manual feed tray (not illustrated) are conveyed from sheet conveyance path 212 to sheet conveyance path 145 by a manual feed roller 213. When each one of the recording sheets S in conveyance thus reaches a resistance roller pair 144, the recording sheet S is stopped by the resistance roller pair 144 which is stationary, which buckles the recording sheet S so that a skew is corrected.

Then, matching the timing with which the polychromatic toner image is conveyed to the secondary transfer nip 126 by the rotation of the intermediate transfer belt 121, the resistance roller pair 144 rotates to convey the recording sheet S to the secondary transfer nip 126. A secondary transfer voltage is applied to the secondary transfer roller 125, and the polychromatic toner image is electrostatically transferred (secondary transfer) from the intermediate transfer belt 121 onto the recording sheet S.

After the secondary transfer, residual toners on the intermediate transfer belt 121 are scraped off and disposed by a cleaning unit 135. The recording sheet S is conveyed to a fixing unit 25. The fixing unit 25 includes a heating roller 136, a fixing belt 137, a fixing roller 138, and a pressure roller 139. The heating roller 136 is heated by a heater (not illustrated), and heats the fixing belt 137 to a fixing temperature.

The fixing belt 137 is an endless belt and is rotated by the fixing roller 138. The fixing roller 138 is rotationally driven by a motor (not illustrated). The pressure roller 139 is in pressure contact with the fixing roller 138 via the fixing belt 137 to form a fixing nip therebetween. The polychromatic toner image is thermally fixed on the recording sheet S when the recording sheet S is fed through the fixing nip.

After the polychromatic toner image is fixed on, the recording sheet S is discharged to a discharge tray 129 above the image forming unit 100 by discharge rollers 128. In a case of duplex printing, the sheet conveyance direction of the recording sheet S is reversed by the discharge rollers 128, and the recording sheet S is conveyed to a sheet inversion path 146 by a hook portion 221, and then to the resistance roller pair 144 by pairs of conveyance rollers 223 and 224. Then, the secondary transfer of the polychromatic toner image is performed on the reverse side of the recording sheet S at the secondary transfer nip 126.

In addition, the image forming unit 100 includes an operation panel 140 which presents information to users of the image forming device 1 and receives input of instructions from the users.

2. Configuration for Determining Sheet Types

Next, a configuration for determining sheet types will be described.

Figure 2:
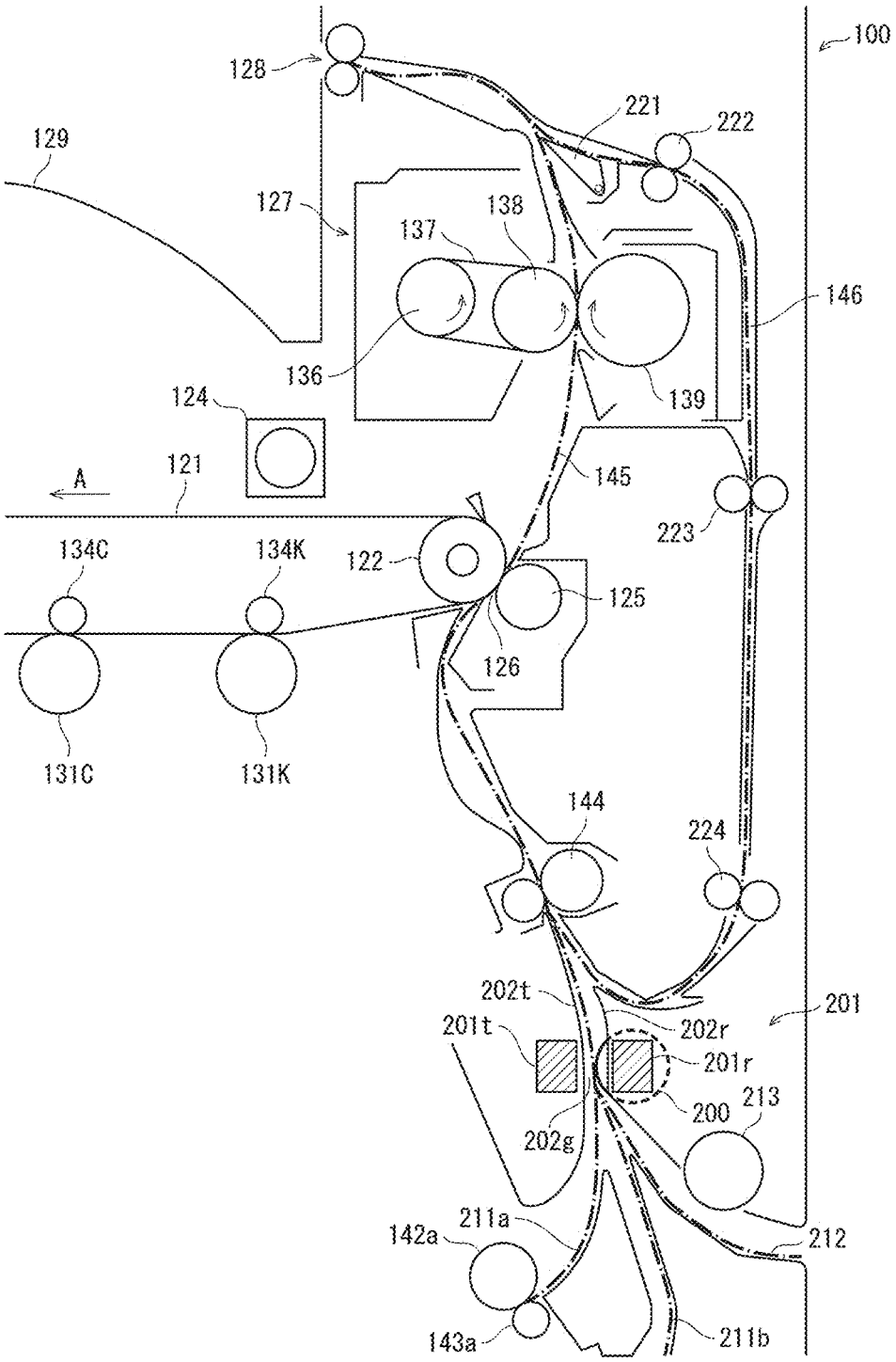
FIG. 2 is a diagram of a configuration for regulating a conveyance state of recording sheet S according to at least one embodiment of the present disclosure.

As in FIG. 2, the photosensor 201 used by a controller 120 to determine the sheet type of the recording sheet S is disposed at a position where three sheet conveyance paths 211*a*, 211*b*, and 212 merge into a sheet conveyance path 145. In order to buckle the recording sheet S for the skew correction, the photosensor 201 is disposed at an upstream side of the resistance roller pair 144 on the sheet conveyance path 145, and at an upstream side of a position where the sheet inversion path 146 merges with the sheet conveyance path 145.

Figure 3:
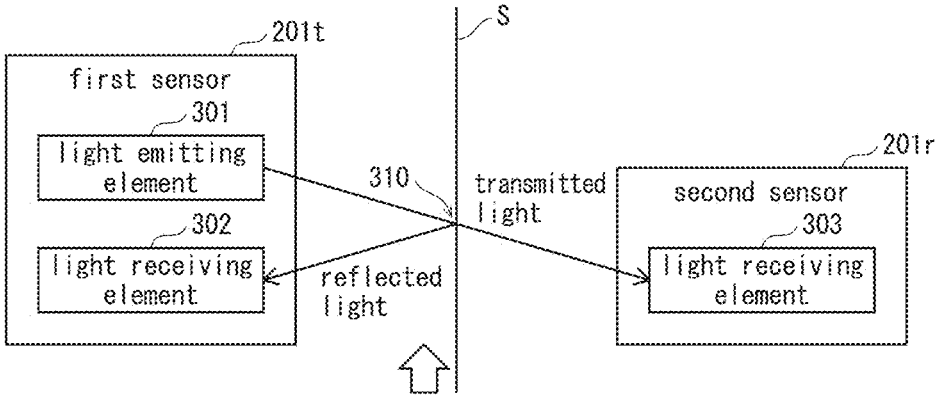
FIG. 3 is a diagram of a configuration of photosensor 201 according to at least one embodiment of the present disclosure.

As in FIG. 3, the photosensor 201 includes the first sensor 201*t* including a light emitting element 301 and a light receiving element 302 and the second sensor 201*r* including only a light receiving element 303, which are disposed opposite to each other. As the light emitting element 301, for example, a light emitting diode (LED) can be used. As the light receiving elements 302 and 303, for example, photodiodes can be used.

Hereinafter, a passing position 310 of the recording sheet S on an optical path which is a path of light emitted from the light emitting element 301 of the first sensor 201*t* and being from the first light emitting element 301 of the first sensor 201*t* to the light receiving element 303 of the second sensor 201*r*, is referred to as a sheet detection position 310.

For each of the recording sheets S, while a leading end of the recording sheet S passes through the sheet detection position 310 and reaches the resistance roller pair 144, the photosensor 201 uses the light receiving element 302 of the first sensor 201*t* to detect for multiple times an amount of reflected light of emitted light reflected by the recording sheet S. The controller 120 determines an average value referring to detected values of the amount of reflected light.

Similarly, for each of the recording sheets S, while a leading end of the recording sheet S passes through the sheet detection position 310 and reaches the resistance roller pair 144, the photosensor 201 uses the light receiving element 303 of the second sensor 201*t* to detect for multiple times an amount of transmitted light of the emitted light transmitted through the recording sheet S. The controller 120 determines an average value referring to detected values of the amount of transmitted light.

The controller 120 determines the sheet type from the average value of the amount of reflected light and the average value of the amount of transmitted light.

Figure 4A:
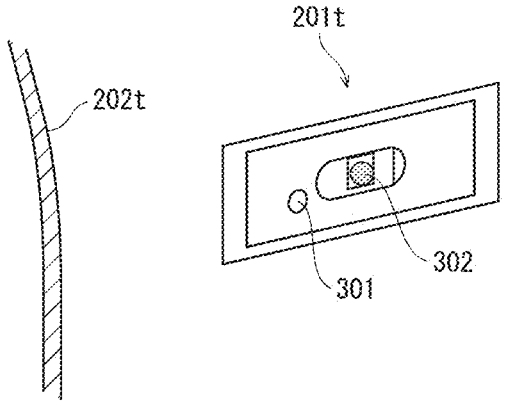
FIG. 4A is a perspective view of an external appearance of first sensor 201*t* according to at least one embodiment.

FIG. 4A is a diagram of the first sensor 201*t* seen from the side of the second sensor 201*r*. The first sensor 201*t* is disposed such that a surface of the first sensor 201*t* is flush with the guide surface 202*t*. The light emitting element 301 is disposed on a front side of the first sensor 201*t* so as to emit light toward the recording sheet S, and the light receiving element 302 is disposed so as to receive light reflected from the recording sheet S.

Figure 4B:
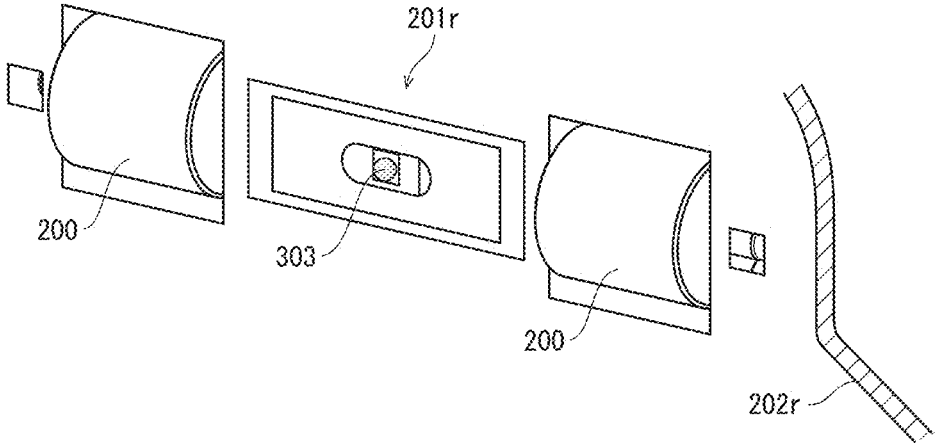
FIG. 4B is a perspective view of an external appearance of second sensor 201*r* and rollers 200 according to at least one embodiment.

FIG. 4B is a diagram of second sensor 201*r* seen from the side of first sensor 201*t*. The second sensor 201*r* is disposed such that a surface of the second sensor 201*r* is flush with the guide surface 202*r*. The light receiving element 302 is disposed at a front side of the second sensor 201*r* so as to receive light transmitted through the recording sheet S.

Rollers 200 are disposed at both sides of the second sensor 201*r* in a width direction of the recording sheet S (a direction on a plane of the recording sheet S which is orthogonal to a conveyance direction of the recording sheet S, hereinafter referred to as "CD direction") so as to protrude from the guide surface 202*r*. Rotation axes of the rollers 200 are disposed parallel to the CD direction. As in FIG. 2, an interval 202*g* is provided between the rollers 200 and the guide surface 202*t* that faces the guide surface 202*r*.

As the interval 202*g* between the guide surface 202*t* and the rollers 200 is 1 mm or more, and the rollers 200 are rotated following the recording sheet S in conveyance, the recording sheet S can easily pass between the guide surface 202*t* and the rollers 200 even if the recording sheet S is thin and has low rigidity. Further, the rollers 200, in the CD direction, do not extend to end portions of the recording sheet S in the CD direction, regulate a conveyance position of the recording sheet S only in a vicinity of the second sensor 201*r*, and do not interfere with the recording sheet S in areas outside of the rollers 200 in the CD direction. The rollers 200 do not hinder conveyance of thin paper in this sense as well.

In at least one embodiment, each of the rollers 200 are 1 cm in length in the CD direction (hereinafter referred to as "CD length"), but the CD length of the rollers 200 is not limited to 1 cm and may be in a different length.

In such a configuration, when the recording sheet S is fed out from the paper feed cassette 141*a* to the sheet conveyance path 211*a* and enters the sheet conveyance path 145, the recording sheet S comes into contact with the guide surface 202*r* due to rigidity of the recording sheet S itself, and moves along the guide surface 202*r* toward the resistance roller pair 144. However, an area of a sheet surface of the recording sheet S which is in the vicinity of the photosensor 201 in the CD direction is pushed by the rollers 200 to a side having the guide surface 202*t*. Thus, the conveyance position of the recording sheet S fed out from the paper feed cassette 141*a* is regulated to a side closer to the first sensor 201*t*.

When the recording sheet S is fed out from the paper feed cassette 141*b* to the sheet conveyance path 211*b*, the recording sheet S is arbitrarily conveyed at a side closer to either the guide surface 202*r* or the guide surface 202*t* as the sheet conveyance path 145 is substantially an extension of the sheet conveyance path 211*b*. However, an area of the sheet surface of the recording sheet S in the vicinity of the photosensor 201 in the CD direction is pushed by the rollers 200 toward a side having the guide surface 202*t*, and thus a displacement range of the conveyance position is regulated.

When the recording sheet S fed out from the manual feed tray to the sheet conveyance path 212 enters the sheet conveyance path 145, the recording sheet S comes into contact with the guide surface 202*t* due to rigidity of the recording sheet S itself, and moves along the surface 202*t* toward the resistance roller pair 144. Therefore, the recording sheet S moves along a side having the guide surface 202*t* without being regulated by the rollers 200.

In any of the cases, the interval is provided between the guide surface 202*t* and the rollers 200, and thus the recording sheet S can move toward the resistance roller pair 144 without being hindered by the rollers 200. The rollers 200 are disposed at the upstream side of the resistance roller pair 144 in the sheet conveyance path 145 and at the upstream side of the position where the sheet inversion path 146 joins the sheet conveyance path 145.

Figure 5A:
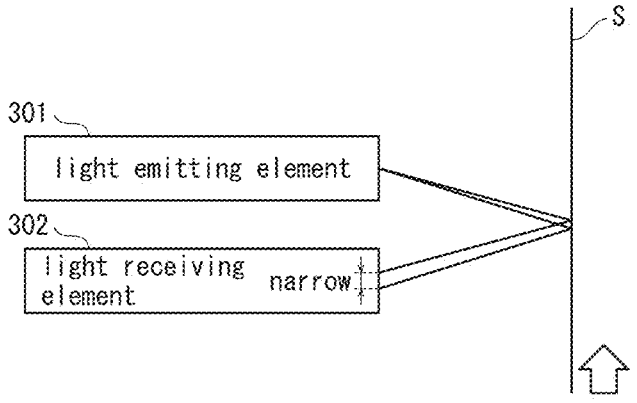
FIG. 5A is a diagram of light receiving state when distance from first sensor 201*t* to recording sheet S is short according to at least one embodiment.
Figure 5B:
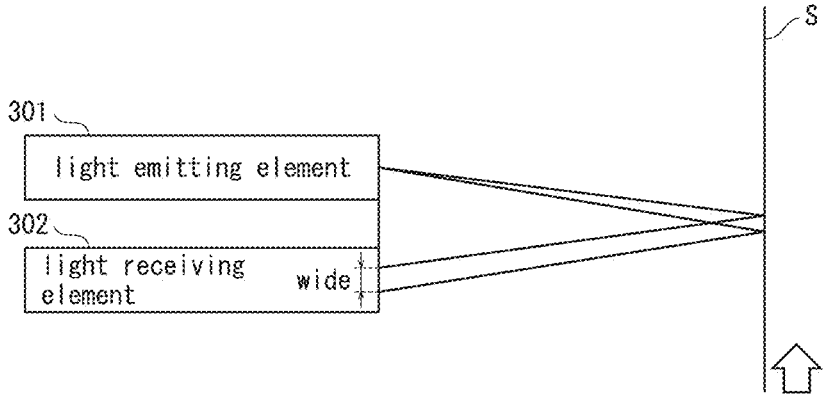
FIG. 5B is a diagram of light receiving state when distance from first sensor 201*t* to recording sheet S is long according to at least one embodiment.

Moreover, a beam diameter of an emitted beam of the light emitting element 301 increases with a distance from the light emitting element 301. Accordingly, when the distance between the first sensor 201*t* and the recording sheet S is short, as in FIG. 5A, the beam diameter of a light entering the light receiving element 302 decreases and an amount of received light per unit area increases. In contrast, when the distance between the first sensor 201*t* and the recording sheet S is long, as in FIG. 5B, the beam diameter of a light entering the light receiving element 302 increases and the amount of received light per unit area decreases. Further, when the beam diameter exceeds a light reception area of the light receiving element 302, portions of the beam outside of the light reception area are not received, and a total of the amount of received light diminishes.

However, a variation range of the distance between the first sensor 201*t* and the recording sheet S is reduced by the rollers 200, which thus stabilizes the amount of light received by the light receiving element 302 and increases the determination accuracy of the sheet types.

3. Sheet Type Determination Processing

Next, sheet type determination processing performed by the controller 120 will be described.

Figure 6:
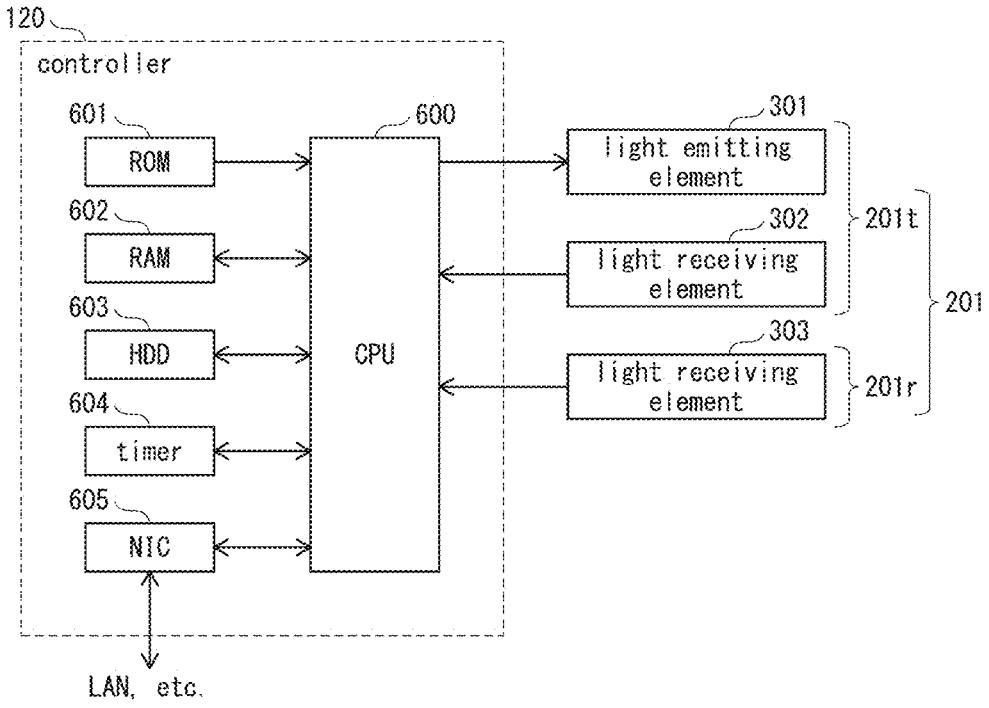
FIG. 6 is a block diagram of a main configuration of controller according to at least one embodiment.

As in FIG. 6, the controller 120 includes a Central Processing Unit (CPU) 600, a Read Only Memory (ROM) 601, a Random Access Memory (RAM) 602, and so on. When power is supplied to the image forming device 1, the CPU 600 reads a boot program from ROM 601 and starts up, then reads an Operating System (OS) and a control program from the Hard Disk Drive (HDD) 603 and executes the OS and the control program using RAM 602 as a working storage area.

Further, the CPU 600 measures times using a timer 604 so as to determine timings to execute the processing. The CPU 600 uses a Network Interface Card (NIC) 605 to mutually communicate with an external device such as a Personal Computer (PC) via a Local Area Network (LAN) or the like. This allows the CPU 600 to accept the print job from the external device and to execute the accepted print job.

The light emitting element 301 and the light receiving elements 302 and 303 are connected to the CPU 600. The CPU 600 controls turning on/off the light emitting element 301, and refers to detection signals of the light receiving elements 302 and 303.

Figure 7:
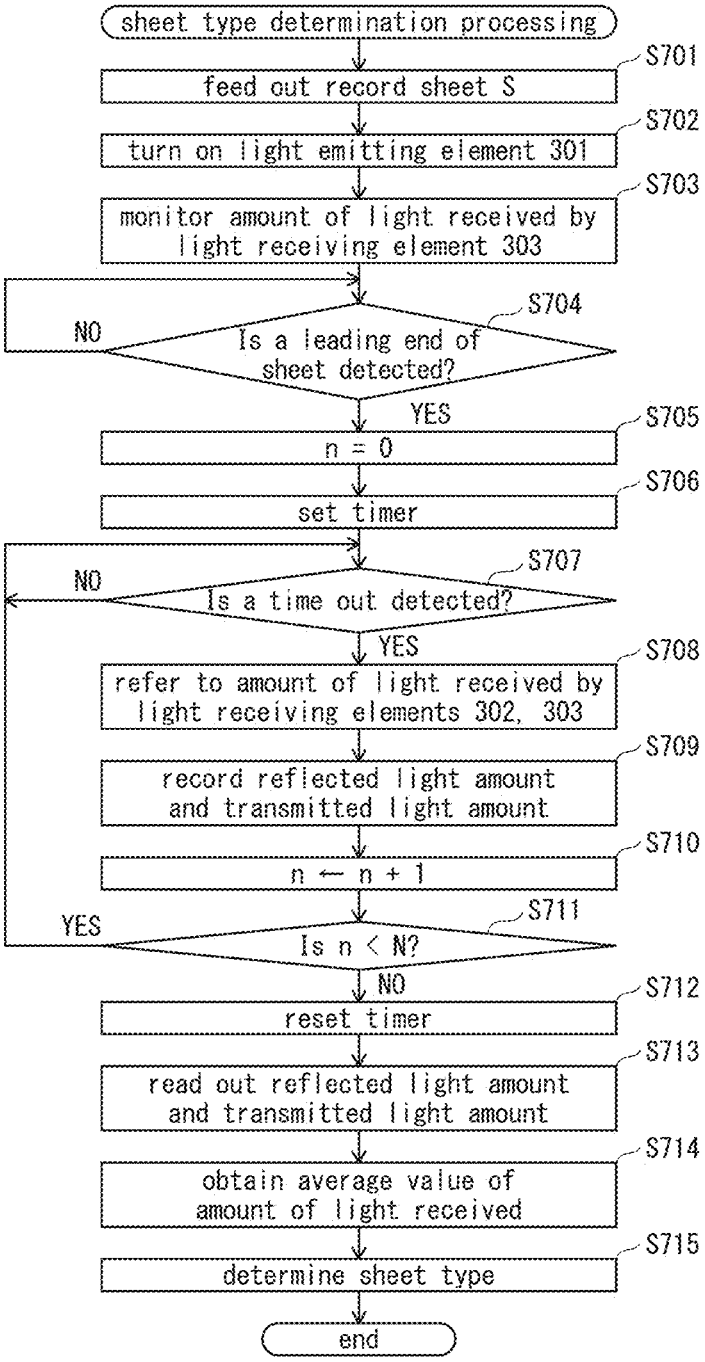
FIG. 7 is a flowchart illustrating sheet type determination processing.

In order to determine the sheet types of the recording sheets S one by one, the CPU 600 executes processing as in FIG. 7 for each of the recording sheets S. First, the CPU 600 feeds out one of the recording sheet S from one of the paper feed cassettes 141*a*, 141*b* or the manual feed tray (S701), turns on the light emitting element 301 of the first sensor 201*t* (S702), and monitors the amount of light received by the light receiving element 303 of the second sensor 201*r* (S703).

Next, when the CPU 600 detects a decrease in the amount of light received by the light receiving element 303 which indicates a leading end of the recording sheet S reaching the sheet detection position 310 (S704: YES), the CPU 600 initializes to 0 a value of a work variable n which indicates the number of times that the amount of the received light by the light receiving elements 302 and 303 have been referred to (S705), and then sets the timer to make interruptions after every lapse of time P (S706). For example, when obtaining an average value by referring to the amount of light received by the light receiving elements 302 and 303 for N times, when T expresses a time from which the leading end of the recording sheet S reaches the sheet detection position 310 to which the leading end of the recording sheet S reaches the pair of resistance roller pair 144, time P is obtained as in a mathematic expression below.

$$P=T+N \tag{1}$$

When a time out by the timer interruption is detected (S707: YES), the CPU 600 refers to the amount of light received by the light receiving elements 302 and 303 (S708), and records in the RAM 602 the amount of reflected light which is the amount of light received by the light receiving element 302 and the amount of transmitted light which is the amount of light received by the light receiving element 303 (S709), and increases the value of the work variable n by 1 (S710). If the value of the work variable n is less than a defined number of trials N (S711: NO), the CPU 600 proceeds to step S707 and repeats the processing above.

When the value of the work variable n is the defined number of trials N or more (S711: YES), the CPU 600 resets the timer 604 to stop making the interruptions (S712), reads out N numbers of the amount of reflected light and N numbers of the amount of transmitted light from the RAM 602 (S713), and then calculates the average values for the amount of reflected light and the amount of transmitted light (S714). Finally, the CPU 600 determines the sheet type from the average value of the amount of reflected light and the average value of the amount of transmitted light (S715), and ends the processing.

4. Modifications

The present disclosure has been described as above based on the embodiments, but the present disclosure is not limited to the embodiments above, and the following modifications may be implemented.

Figure 8A:
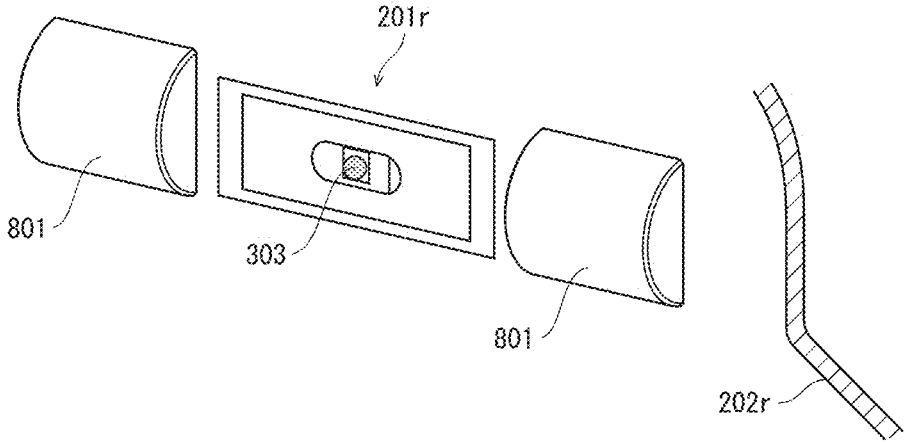
FIG. 8A is a perspective view of an external appearance of second sensor 201*r* and cylindrical protrusion according to at least one embodiment.
Figure 8B:
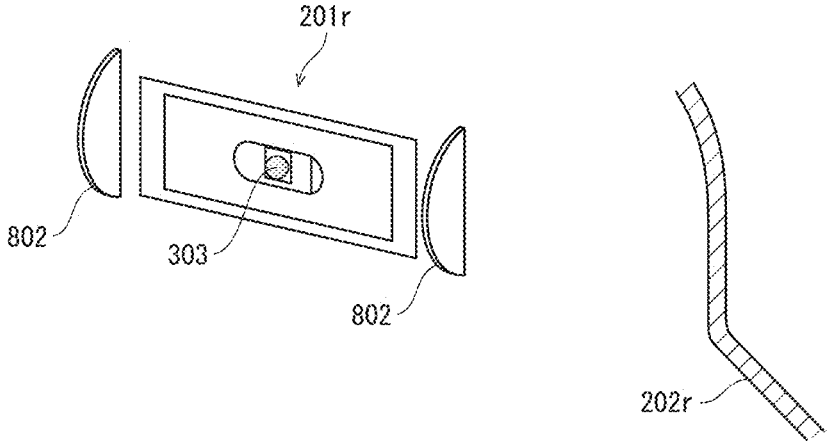
FIG. 8B is a perspective view of an external appearance of second sensor 201*r* and arc shaped rib portions according to at least one embodiment.

(4-1) At least one embodiment above describes an example in which the rollers 200 are disposed at the guide surface 202*r*, but the present disclosure is not limited thereto, and arc shaped protrusions as viewed from the CD direction may be provided instead of the rollers 200. The arc shaped protrusions may be cylindrical surfaces 801 disposed on the guide surface 202*r* as in FIG. 8A or arc shaped rib portions 802 disposed on the guide surface 202*r* as in FIG. 8B.

When the arc shaped protrusions as viewed from the CD direction are disposed on the guide surface 202*r*, regardless of whether or not the arc shaped protrusions rotate following the recording sheet S, the effect of the present disclosure can be obtained if the displacement range in the direction perpendicular to the sheet surface of the recording sheet S passing through the sheet detection position 310 (direction of the interval 202*g* which is between the guide surfaces 202*t* and 202*r*) can be regulated.

The arc shaped protrusions may be a component separate from or integrated with the guide surfaces 202*t* and 202*r*.

(4-2) At least one embodiment above describes an example in which the rollers 200 are disposed at both sides of the second sensor 201*r* in the CD direction, but the present disclosure is not limited thereto, and may be modified as below.

Figure 9A:
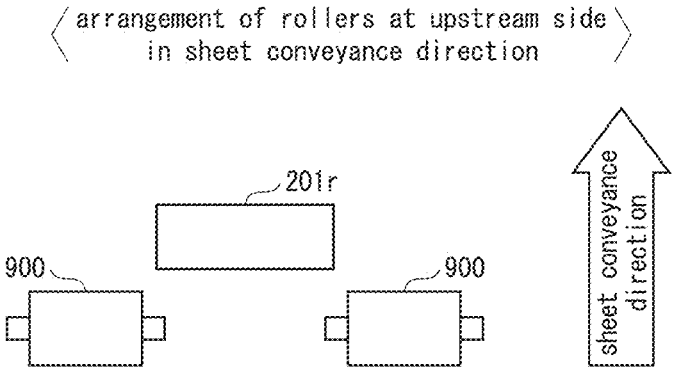
FIG. 9A is a diagram of rollers 900 disposed at an upstream side in a sheet conveyance direction according to at least one embodiment.

For example, as in FIG. 9A, protrusions 900 such as rollers may be disposed at the upstream side of the second sensor 201*r* in the sheet conveyance direction.

In addition to the upstream side of the second sensor 201*r* in the sheet conveyance direction, protrusions such as rollers may be disposed at the downstream side of the second sensor 201*r* in the sheet conveyance direction. For example, as in FIG. 9B-1 pattern 1, protrusions 901 provided with the CD length longer than that of the second sensor 201*r* are disposed at the upstream side and the downstream side in the sheet conveyance direction, sandwiching the second sensor 201*r*. In this way, the displacement range in the direction perpendicular to the sheet surface of the recording sheet S can be reliably regulated.

Figures 1, 9B:
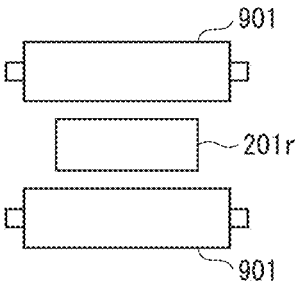
Figures 2, 9B:
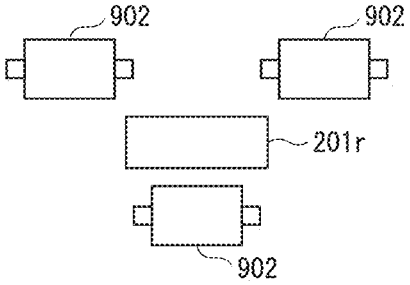
Figures 3, 9B:
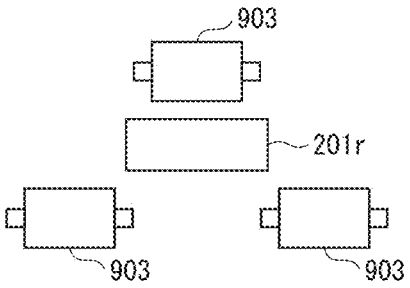

In FIG. 9B-2 pattern 2, protrusions 902 are each provided with the CD lengths equal to or shorter than that of the second sensor 201*r*. While two of the protrusions 902 are disposed adjacent to each other in the CD direction at the upstream side of the second sensor 201*r* in the sheet conveyance direction, only one of the protrusions 902 is disposed at the same position as the second sensor 201*r* in the CD direction at the downstream side of the second sensor 201*r* in the sheet conveyance direction.

In this way, in comparison with an arrangement in FIG. 9B-1, a contact area between the protrusions 902 and the recording sheet S is smaller than the contact area between the protrusions 901 and the recording sheet S, and thus frictional resistance generated during conveyance of the recording sheet S can be reduced. Thus, the recording sheet S can be conveyed more smoothly.

In FIG. 9B-3 pattern 3, the arrangement of protrusions 903 is opposite to that of the protrusions 902 in FIG. 9B-2 at the upstream side and the downstream side in the sheet conveyance direction. The same effect as in FIG. 9B-2 can be obtained with this arrangement.

Figures 4, 9B:
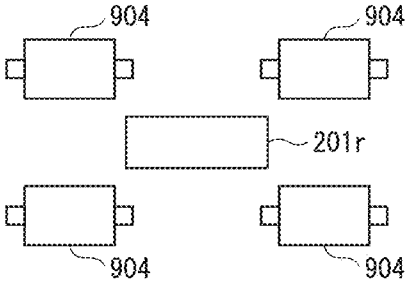

Further, in FIG. 9B-4 pattern 4, the protrusions 901 in FIG. 9B-1 are each replaced with two protrusions 904 adjacent to each other in the CD direction. Frictional resistance between the recording sheet S and the protrusions can be reduced in this way as well, and thus the recording sheet S can be conveyed more smoothly than the arrangement in FIG. 9B-1. Further, the displacement range in the direction perpendicular to the sheet surface of the recording sheet S can be more reliably reduced in comparison with the arrangements in FIGS. 9B-2 and 9B-3.

Figure 10:
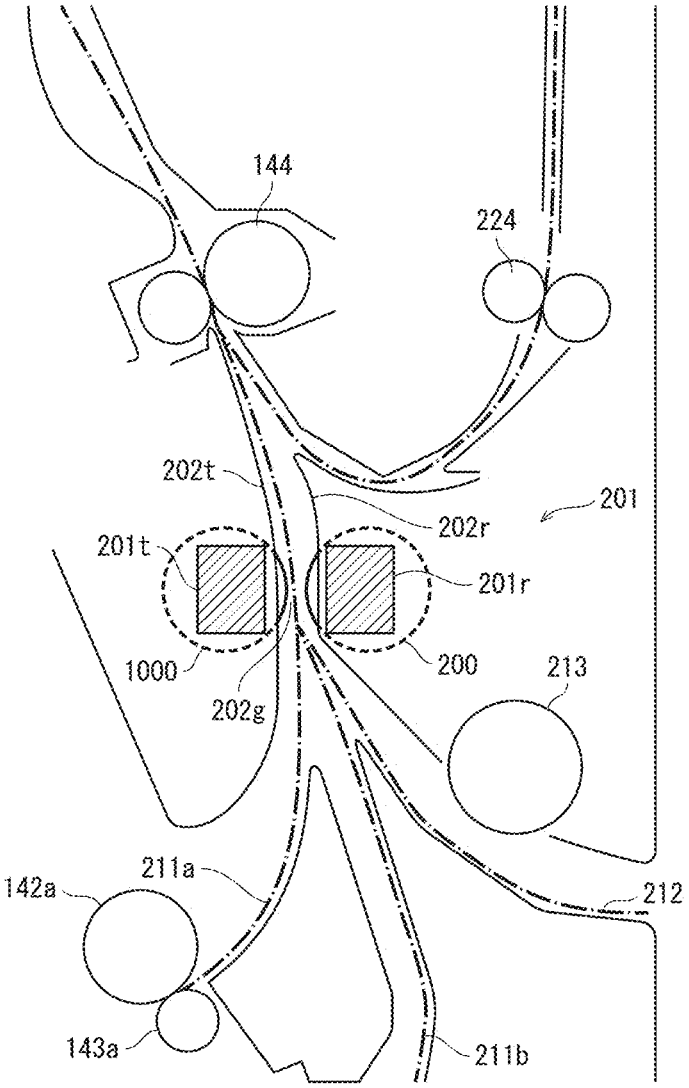
FIG. 10 is a diagram in which roller 1000 is disposed at a side having guide surface 202*t* in addition to roller 200 disposed at a side having guide surface 202*r*, according to at least one embodiment.

(4-3) At least one embodiment above describes an example in which the rollers 200 are disposed at the side having the guide surface 202*r*, but the present disclosure is not limited thereto, and the same effect of the present disclosure may be obtained when the rollers are disposed at the side having the guide surface 202*t* instead of 202*r*. Further, as in FIG. 10, in addition to a roller 200 disposed at the side having the guide surface 202*r*, a roller 1000 may be disposed at the side having the guide surface 202*t* and at a position spaced from the roller 200 by a defined distance of the interval 202*g*.

A path width of the sheet conveyance path 145 is smaller at the sheet detection position 310 compared to the path widths in other areas of the sheet conveyance path 145 in the direction perpendicular to the sheet surface of the recording sheet S. Thus, frictional resistance easily occurs between the recording sheet S and the guide surfaces 202*t* and 202*r*, and between the recording sheet S and the protrusions, which may prevent smooth conveyance of the recording sheet S and induce risks of sheet jams.

However, if rollers are disposed both at the side having the guide surface 202*t* and at the side having the guide surface 202*r*, the roller 200 and the roller 1000 rotate so as to follow the recording sheet S, and minimize the frictional resistance generated by the recording sheet S passing through the sheet detection position 3. And thus the recording sheet S is smoothly conveyed and sheet jams can be prevented.

(4-4) At least one embodiment above describes an example in which the sheet types are determined by using the average values of the amount of the received light detected by the light receiving elements 302 and 303, but the present disclosure is not limited thereto, and may be modified as below.

As in FIG. 5, when a distance between a first sensor 201*t* and the recording sheet S varies, a diameter of a beam received by a light receiving element 301 of the first sensor 201*t* and an amount of light per unit area varies. In the present disclosure, rollers 200 are disposed so as not to contact the guide surface 202*t* in order to prevent occurrence of failures when the recording sheet S is thin paper, and thus a variation in the distance between the first sensor 201*t* and the recording sheet S cannot be completely eliminated.

In contrast, the distance between the recording sheet S and the first sensor 201*t* at the sheet detection position 310 is recognized to have a specific tendency depending on whether the recording sheet S is fed out from the paper feed cassettes 141*a*, 141*b* or the manual feed tray. Therefore, focusing on this tendency can further increase the determination accuracy of the sheet types.

As described above, the recording sheet S fed out from the paper feed cassette 141*a* tends to be conveyed along the guide surface 202*r*. Therefore, at the sheet detection position 310, the distance from the first sensor 201*t* to the recording sheet S tends to be large, and accordingly, an amount of received light detected by the light receiving element 302 of the first sensor 201*t* tends to decrease.

On the other hand, as the recording sheet S fed out from the manual feed tray tends to be conveyed along the guide surface 202*t*, and the distance from the first sensor 201*t* to the recording sheet S tends to be small at the sheet detection position 310, the amount of received light detected by the light receiving element 302 of the first sensor 201*t* tends to increase. With respect to the recording sheet S fed out from the paper feed cassette 141*b* of the image forming device according to at least one embodiment, a specific tendency cannot be recognized.

Figure 11:
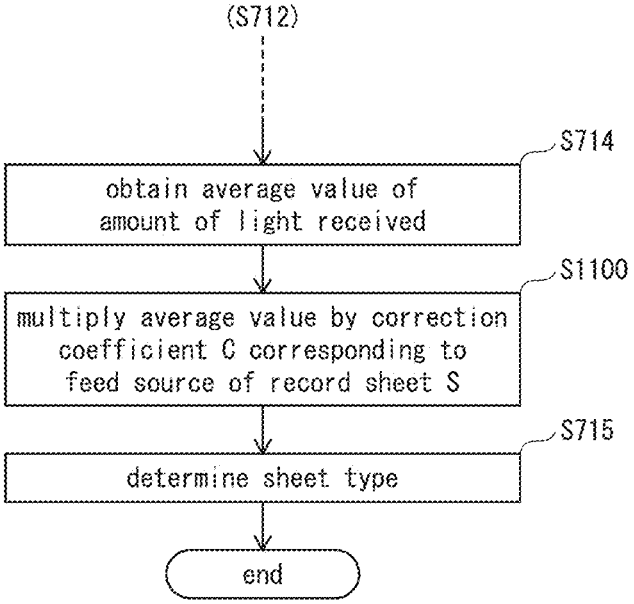
FIG. 11 is a flowchart illustrating correction processing of an amount of received light according to a feed source of a recording sheet S.

Based on such knowledge, as in FIG. 11, step S1100 of processing is performed between step S714 and step S715 in FIG. 7. Specifically, after an average value of an amount of reflected light is obtained (S714), the average value is multiplied by a correction coefficient C corresponding to a feed source of the recording sheet S, and thus a new average value is obtained (S705).

When the recording sheet S is fed out from the paper feed cassette 141*a*, the amount of reflected light detected by the light receiving element 302 tends to decrease, and thus the average value is multiplied by a value larger than 1 as the correction coefficient C. Alternatively, when the recording sheet S is fed out from the manual feed tray, the amount of reflected light detected by the light receiving element 302 tends to increase, and thus the average value is multiplied by a value smaller than 1 as the correction coefficient C.

Specific value of the correction coefficient C is preferably determined according to a distance from the light receiving surface of the light receiving element 302 to the guide surface 202*t* and a distance from the light receiving surface of the light receiving element 302 to a position where the roller 200 contacts the recording sheet S.

Calculation results are the same in terms of correcting average values, whether a calculation result is obtained by calculating an average value of the detected values of the amount of reflected light and then multiplying by the correction coefficient C, or by multiplying the detected value of the amount of reflected light by the correction coefficient C and then calculating an average value.

Thus, by correcting the average value of the amount of reflected light according to a tendency of the passing position of the recording sheet S at the sheet detection position 310, the determination accuracy of the sheet types can be increased while preventing occurrence of failures when the recording sheet S is thin paper.

Note that the amount of transmitted light received by the light reception element 303 attenuates at a constant rate irrespective of the passing position of the recording sheet S. Therefore, unlike the average value of the amount of reflected light, no correction needs to be made for the average value of the amount of transmitted light according to a change in the passing position of the recording sheet S according to the feed source of the recording sheet S.

(4-5) At least one embodiment above describes an example in which three feed sources are provided for the recording sheet S, such as feed cassettes 141*a*, 141*b*, and the manual feed tray, but the same effect of the present disclosure is obtained when two or less, or four or more feed sources are provided for the recording sheet S.

(4-6) At least one embodiment above describes an example in which the rollers 200 are used to regulate the conveyance position of the recording sheet S, but the present disclosure is not limited thereto. A conveyance roller may be disposed instead of the roller 200 and rotated in the conveyance direction of the recording sheet S. The conveyance roller should be disposed at least at one of the sides having the guide surface 202*t* or 202*r*.

Similar to the arrangement of the rollers 200, the conveyance roller may be disposed spaced from and at an opposite side of another conveyance roller, the guide surface 202*t*, and the guide surface 202*r* with respect to a direction perpendicular to the sheet surface of the recording sheet S in conveyance. Such arrangement is further preferable for preventing the occurrence of failures such as sheet jams when the recording sheet S is thin paper. When the conveyance roller is used as a regulating member for the conveyance position of the recording sheet S, no stress in a direction opposite to the conveyance direction is applied to the recording sheet S during conveyance, and thus the occurrence of failures can be more reliably prevented in a case where the recording sheet S is thin paper.

(4-7) At least one embodiment above describes an example in which the image forming device 1 is the copying device that forms polychromatic images using the tandem electrophotographic method, but the present disclosure is not limited thereto. The image forming device 1 may be the copying device that forms polychromatic images using a method other than the tandem electrophotographic method, or the copying device that forms only monochrome images. Moreover, a similar effect can be obtained by applying the present disclosure to single-function devices such as a printing device without the image reading unit 150 or a facsimile device having a facsimile communication function, or to the multi-function peripheral (MFP) which combines such functions.

5. Summary of Embodiment

The above embodiments and modifications represent one or more aspect of the present disclosure, and are summarized as in the following.

That is, a sheet type determining device includes a guide that guides a sheet along a sheet conveyance path to a destination, the sheet conveyance path being between a first guide surface and a second guide surface disposed facing each other across an interval; a determiner that determines a sheet type when the sheet is in the sheet conveyance path, without having contact with the sheet in conveyance; and one or more regulators, each of the regulators regulating a displacement range of the sheet in a direction of the interval between the first and the second guide surfaces, at a detection position in the sheet conveyance path where the determiner determines the sheet type, wherein each of the regulators is a member that protrudes in an arc shape from the first or the second guide surface toward the guide surface opposite, and each of the regulators is spaced from the guide surface or another one of the regulators opposite in a direction perpendicular to a surface of the sheet.

In the sheet type determining device, when the number of the regulators is two or more, the regulators protruding from the first or the second guide surface are disposed at both sides of the detection position in a width direction of the sheet in conveyance.

In the sheet type determining device, when the number of the regulators is two or more, the regulators protruding from the first or the second guide surface are disposed at both sides of the detection position in a conveyance direction of the sheet.

In the sheet type determining device, the regulators are disposed upstream of the detection position in a conveyance direction of the sheet.

In the sheet type determining device, when the number of the regulators is two or more, the regulators protrude from the first and the second guide surfaces, and the regulators face each other across the sheet conveyance path spaced from each other.

In the sheet type determining device, each of the regulators is a roller rotated by the sheet in conveyance, the roller having a width direction of the sheet in conveyance as a rotation axis.

In the sheet type determining device, each of the regulators is a roller member having a width direction of the sheet in conveyance as a rotation axis, and the roller member is rotationally-driven in a conveyance direction of the sheet when at least a leading end of the sheet reaches a position of the roller member in the sheet conveyance path.

In the sheet type determining device, each of the regulators is spaced 1 mm or more from the guide surface or another one of the regulators opposite in the direction perpendicular to the surface of the sheet.

In the sheet type determining device, the determiner includes a light emitting element and a light receiving element, and determines the sheet type using at least a value of an amount of light reflected from the sheet or a value of an amount of light transmitted through the sheet.

In the sheet type determining device, when the sheet can be conveyed from different conveyance sources to the detection position, the determiner corrects the value of the amount of light reflected from the sheet according to a conveyance source of the sheet and determines the sheet type using a corrected value of the amount of light reflected.

An image forming device includes a sheet type determining device; and an image former that forms an image on a sheet after a sheet type is determined by the sheet type determining device, the image being formed according to an image forming condition determined by a determination result of the sheet type determining device, wherein the sheet type determining device includes a guide that guides a sheet along a sheet conveyance path to a destination, the sheet conveyance path being between a first guide surface and a second guide surface disposed facing each other across an interval; a determiner that determines a sheet type when the sheet is in the sheet conveyance path, without having contact with the sheet in conveyance; and one or more regulators, each of the regulators regulating a displacement range of the sheet in a direction of the interval between the first and the second guide surfaces, at a detection position in the sheet conveyance path where the determiner determines the sheet type, wherein each of the regulators is a member that protrudes in an arc shape from the first or the second guide surface toward the guide surface opposite, and each of the regulators is spaced from the guide surface or another one of the regulators opposite in a direction perpendicular to a surface of the sheet.

The image forming device further includes a resistance roller pair that controls a timing for conveying the sheet in order to transfer a toner image to the sheet, wherein the determiner and each of the regulators are disposed upstream of the resistance roller pair in a sheet conveyance direction.

In this way, as the regulating member is disposed so as not to contact with a member countering each other with respect to the direction perpendicular to the surface of the sheet, the determination accuracy of the sheet types are increased while the occurrence of failures such as sheet jams are suppressed even when the recording sheets are thin paper.

Although one or more embodiments of the present disclosure have been described and illustrated in detail, the disclosed embodiments are made for the purposes of illustration and example only and not limitation. The scope of the present disclosure should be interpreted by the terms of the appended claims.

What is claimed is:

1. A sheet type determining device comprising:

a guide that guides a sheet along a sheet conveyance path to a destination, the sheet conveyance path being between a first guide surface and a second guide surface disposed facing each other across an interval;

a determiner that determines a sheet type when the sheet is in the sheet conveyance path, without having contact with the sheet in conveyance; and one or more regulators, each of the regulators regulating a displacement range of the sheet in a direction of the interval between the first and the second guide surfaces, at a determining position in the sheet conveyance path where the determiner determines the sheet type, wherein each of the regulators is a member that protrudes in an arc shape from the first or the second guide surface toward the guide surface opposite, and each of the regulators is spaced from the guide surface or another one of the regulators opposite in a direction perpendicular to a surface of the sheet;

wherein the number of the regulators is two or more, the regulators protruding from the first or the second guide surface are disposed at both sides of the determiner in a width direction of the sheet in conveyance.

2. The sheet type determining device according to claim 1, wherein the number of the regulators is two or more, the regulators protruding from the first or the second guide surface are disposed at both sides of the determining position in a conveyance direction of the sheet.

3. The sheet type determining device according to claim 1, wherein the regulators are disposed upstream of the determining position in a conveyance direction of the sheet.

4. The sheet type determining device according to claim 1, wherein the number of the regulators is two or more, the regulators protrude from the first and the second guide surfaces, and the regulators face each other across the sheet conveyance path spaced from each other.

5. The sheet type determining device according to claim 1, wherein each of the regulators is a roller rotated by the sheet in conveyance, the roller having a width direction of the sheet in conveyance as a rotation axis.

6. The sheet type determining device according to claim 1, wherein each of the regulators is a roller member having a width direction of the sheet in conveyance as a rotation axis, and the roller member is rotationally-driven in a conveyance direction of the sheet when at least a leading end of the sheet reaches a position of the roller member in the sheet conveyance path.

7. The sheet type determining device according to claim 1, wherein each of the regulators is spaced 1 mm or more from the guide surface or another one of the regulators opposite in the direction perpendicular to the surface of the sheet.

8. The sheet type determining device according to claim 1, wherein the determiner comprises a light emitting element and a light receiving element, and determines the sheet type using at least a value of an amount of light reflected from the sheet or a value of an amount of light transmitted through the sheet.

9. The sheet type determining device according to claim 8, wherein when the sheet can be conveyed from different conveyance sources to the determining position, the determiner corrects the value of the amount of light reflected from the sheet according to a conveyance source of the sheet and determines the sheet type using a corrected value of the amount of light reflected.

10. An image forming device comprising:

a sheet type determining device; and an image former that forms an image on a sheet after a sheet type is determined by the sheet type determining device, the image being formed according to an image forming condition determined by a determination result of the sheet type determining device, wherein the sheet type determining device comprises a guide that guides a sheet along a sheet conveyance path to a destination, the sheet conveyance path being between a first guide surface and a second guide surface disposed facing each other across an interval;

a determiner that determines a sheet type when the sheet is in the sheet conveyance path, without having contact with the sheet in conveyance; and one or more regulators, each of the regulators regulating a displacement range of the sheet in a direction of the interval between the first and the second guide surfaces, at a determining position in the sheet conveyance path where the determiner determines the sheet type, wherein each of the regulators is a member that protrudes in an arc shape from the first or the second guide surface toward the guide surface opposite, and each of the regulators is spaced from the guide surface or another one of the regulators opposite in a direction perpendicular to a surface of the sheet;

wherein the number of the regulators is two or more, the regulators protruding from the first or the second guide surface are disposed at both sides of the determiner in a width direction of the sheet in conveyance.

11. The image forming device according to claim 10, further comprising a resistance roller pair that controls a timing for conveying the sheet in order to transfer a toner image to the sheet, wherein the determiner and each of the regulators are disposed upstream of the resistance roller pair in a sheet conveyance direction.

* * * * *